US012104297B1

(12) United States Patent
Waldman et al.

(10) Patent No.: US 12,104,297 B1
(45) Date of Patent: Oct. 1, 2024

(54) CHEMICAL RESISTANT FABRIC

(71) Applicant: Global Trademarks, Inc., Easton, PA (US)

(72) Inventors: Mark Waldman, New Hope, PA (US); Ruth Gordon, Bernardsville, NJ (US)

(73) Assignee: Global Trademarks, Inc.

( * ) Notice: Subject to any disclaimer, the term of this patent is extended or adjusted under 35 U.S.C. 154(b) by 126 days.

(21) Appl. No.: 17/591,667

(22) Filed: Feb. 3, 2022

Related U.S. Application Data

(60) Provisional application No. 63/145,020, filed on Feb. 3, 2021.

(51) Int. Cl.
*D04B 21/16* (2006.01)

(52) U.S. Cl.
CPC ..... *D04B 21/16* (2013.01); *D10B 2401/061* (2013.01); *D10B 2501/04* (2013.01)

(58) Field of Classification Search
CPC ..... D04B 21/06; D04B 21/16; D04B 21/18; D10B 2501/04; D10B 2401/061
USPC ..... 66/192, 193, 195
See application file for complete search history.

(56) References Cited

U.S. PATENT DOCUMENTS 519,101 A * 5/1894 Spooner ..... D04B 21/18 D5/47
752,033 A * 2/1904 Clewley ..... D04B 21/10 66/193
1,931,822 A 4/1933 Hoffman
2,060,689 A 10/1935 Read
2,136,367 A * 11/1938 Amidon ..... D04B 21/18 66/192
2,149,032 A * 2/1939 Schonfeld ..... D04B 21/18 66/84 R
2,153,645 A * 4/1939 Schonfeld ..... D04B 21/18 66/192
2,183,108 A * 12/1939 Schonfeld ..... D04B 21/18 66/192
2,199,449 A * 5/1940 Schonfeld ..... D04B 21/18 66/203
2,267,578 A * 12/1941 Schonfeld ..... D04B 23/22 66/203
2,289,302 A * 7/1942 Bradshaw ..... D04B 21/18 66/195
2,323,396 A * 7/1943 Hayto ..... D04B 1/18 66/195
2,411,175 A * 11/1946 Wagler ..... D04B 21/18 66/193
2,800,783 A * 7/1957 Abood ..... D04B 21/08 66/84 R
2,910,853 A * 11/1959 Howard ..... D04B 21/18 66/172 R (Continued)

*Primary Examiner* — Danny Worrell
(74) *Attorney, Agent, or Firm* — BELLES KATZ LLC

(57) ABSTRACT

Described herein is a fabric having a warp knit construction comprising a first yarn forming a plurality of stitches, the first yarn being a hard yarn and having a first denier ranging from about 20 to about 150, a second yarn in-laid through the first yarn, the second yarn being an elastomeric yarn and having a second denier ranging from about 210 to about 450; and, wherein the first yarn is present in an amount ranging from about 90 wt. % to about 99 wt. % based on the total weight of the fabric, and wherein the second yarn is present in an amount ranging from about 1 wt. % to about 10 wt. % based on the total weight of the fabric.

20 Claims, 7 Drawing Sheets

(56) References Cited

U.S. PATENT DOCUMENTS

| | | | | | |
|---|---|---|---|---|---|
| 2,960,855 | A * | 11/1960 | Siciliano | D04B 21/18 | 450/156 |
| 2,992,550 | A * | 7/1961 | Frith, Jr. | D04B 21/10 | 66/195 |
| 3,077,758 | A * | 2/1963 | Siciliano | D04B 21/12 | 2/DIG. 9 |
| 3,084,529 | A * | 4/1963 | Scheibe | D04B 21/10 | 66/193 |
| 3,106,079 | A * | 10/1963 | Kohl | D04B 21/18 | 66/193 |
| 3,183,685 | A * | 5/1965 | Riehl | D04B 21/12 | 66/193 |
| 3,672,187 | A * | 6/1972 | Simpson | D04B 21/165 | 66/192 |
| 3,691,796 | A * | 9/1972 | Mayer | D04B 21/00 | 66/193 |
| 3,733,859 | A * | 5/1973 | Wittmann | D04B 21/12 | 66/193 |
| 3,910,075 | A | 10/1975 | Holliday | | |
| 3,922,888 | A * | 12/1975 | Patterson | D04B 21/18 | D5/47 |
| 4,074,543 | A * | 2/1978 | Schmidt | D04B 21/12 | 66/193 |
| 4,103,485 | A * | 8/1978 | Brues | D04B 21/18 | 66/192 |
| 4,377,007 | A | 3/1983 | Sudjian | | |
| 4,528,699 | A | 7/1985 | Hughes | | |
| 4,748,078 | A * | 5/1988 | Doi | D04B 21/08 | 66/169 A |
| 5,083,316 | A | 1/1992 | Kuehner et al. | | |
| 5,184,968 | A | 2/1993 | Michalochick et al. | | |
| 5,359,732 | A | 11/1994 | Waldman et al. | | |
| 6,758,068 | B2 * | 7/2004 | Shirasaki | D04B 21/16 | 66/170 |
| 7,465,683 | B2 | 12/2008 | McMurray | | |
| 7,727,286 | B2 | 6/2010 | Reid et al. | | |
| 8,322,168 | B2 * | 12/2012 | Wall | D04B 21/18 | 66/193 |
| 8,726,700 | B2 | 5/2014 | Waldman et al. | | |
| 8,769,718 | B2 | 7/2014 | Riehl | | |
| D806,359 | S | 1/2018 | Waldman | | |
| 9,896,790 | B2 * | 2/2018 | Ko | D03D 19/00 | |
| 2007/0174972 | A1 | 8/2007 | Carney et al. | | |
| 2010/0229605 | A1 * | 9/2010 | Keitch | D04B 21/12 | 66/193 |
| 2012/0297840 | A1 | 11/2012 | Yeung | | |
| 2016/0122907 | A1 | 5/2016 | Liu et al. | | |
| 2019/0309452 | A1 | 10/2019 | Liao et al. | | |

* cited by examiner

CHEMICAL RESISTANT FABRIC

CROSS-REFERENCE TO RELATED APPLICATIONS

The present application claims the benefit of priority to U.S. Provisional Patent Application Ser. No. 63/145,020, filed on Feb. 3, 2021, the entirety of which is incorporated herein by reference.

BACKGROUND

Stretch fabrics have many applications in active wear, which expose these materials to conditions that may not be suitable for prolonged deformation and recovery in such stretch fabrics—such as chlorinated pools. Therefore, a need exists for a new stretch fabric that is suitable for such active wear applications, and which can exhibit the necessary prolonged recovery characteristics that are needed for such applications.

BRIEF SUMMARY

In some embodiments, the present invention is directed to a fabric having a warp knit construction comprising: a repeating array of cells, each cell defined by an inlay yarn; a plurality of stiches formed inside of each cell, the plurality of stitches formed by a hard yarn; and wherein the number of stitches per cell ranges from about 20 to about 300.

Other embodiments of the present invention include a fabric having a warp knit construction comprising: a first yarn forming a plurality of stitches extending along in a knit direction, the first yarn having a first denier; a second yarn in-laid through the first yarn, the second yarn extending along the knit direction and having a repeating pattern that extends across at least 4 wales for every 4 courses, the second yarn having a second denier; and wherein a ratio of the second denier to the first denier ranges from about 2:1 to about 15:1.

Other embodiments of the present invention include a fabric having a warp knit construction comprising: a first yarn forming a plurality of stitches, the first yarn being a hard yarn and having a first denier ranging from about 20 to about 150; a second yarn in-laid through the first yarn, the second yarn being an elastomeric yarn and having a second denier ranging from about 210 to about 450; and wherein the first yarn is present in an amount ranging from about 90 wt. % to about 99 wt. % based on the total weight of the fabric, and wherein the second yarn is present in an amount ranging from about 1 wt. % to about 10 wt. % based on the total weight of the fabric.

Other embodiments of the present invention include a fabric having a warp knit construction, the fabric having a first major surface opposite a second major surface, the warp knit construction comprising: a repeating array of cells, each cell having a perimeter that is defined by an inlay yarn; a repeating array of central regions, each central region located inside of the perimeter of each cell, and each central region comprising a plurality of stitches that are formed by a hard yarn; and wherein in a first state, no external stress is applied to the fabric and in a second state, external stress is applied to the fabric in a direction substantially parallel to each of the first major surface and the second major surface; and wherein in the first state the repeating array of central regions exhibit a thickness ranging from about 60 mils to about 120 mils, as measured between the first major surface and the second major surface of the fabric, and wherein in the second state, the repeating array of central regions exhibit a thickness ranging from about 10 mils to about 30 mils, as measured between the first major surface and the second major surface of the fabric.

Other embodiments of the present invention include a swimsuit comprising the aforementioned fabric.

Other embodiments of the present invention include a method of knitting a fabric comprising: knitting a first yarn to form a plurality of stitches that extends in a vertical direction, the first yarn having a first denier; in-laying a second yarn with the first yarn such that the second yarn extends along the vertical direction and has a repeating pattern that extends across at least 4 wales for every 4 courses, the second yarn having a second denier; and wherein a ratio of the second denier to the first denier ranges from about 2:1 to about 15:1.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
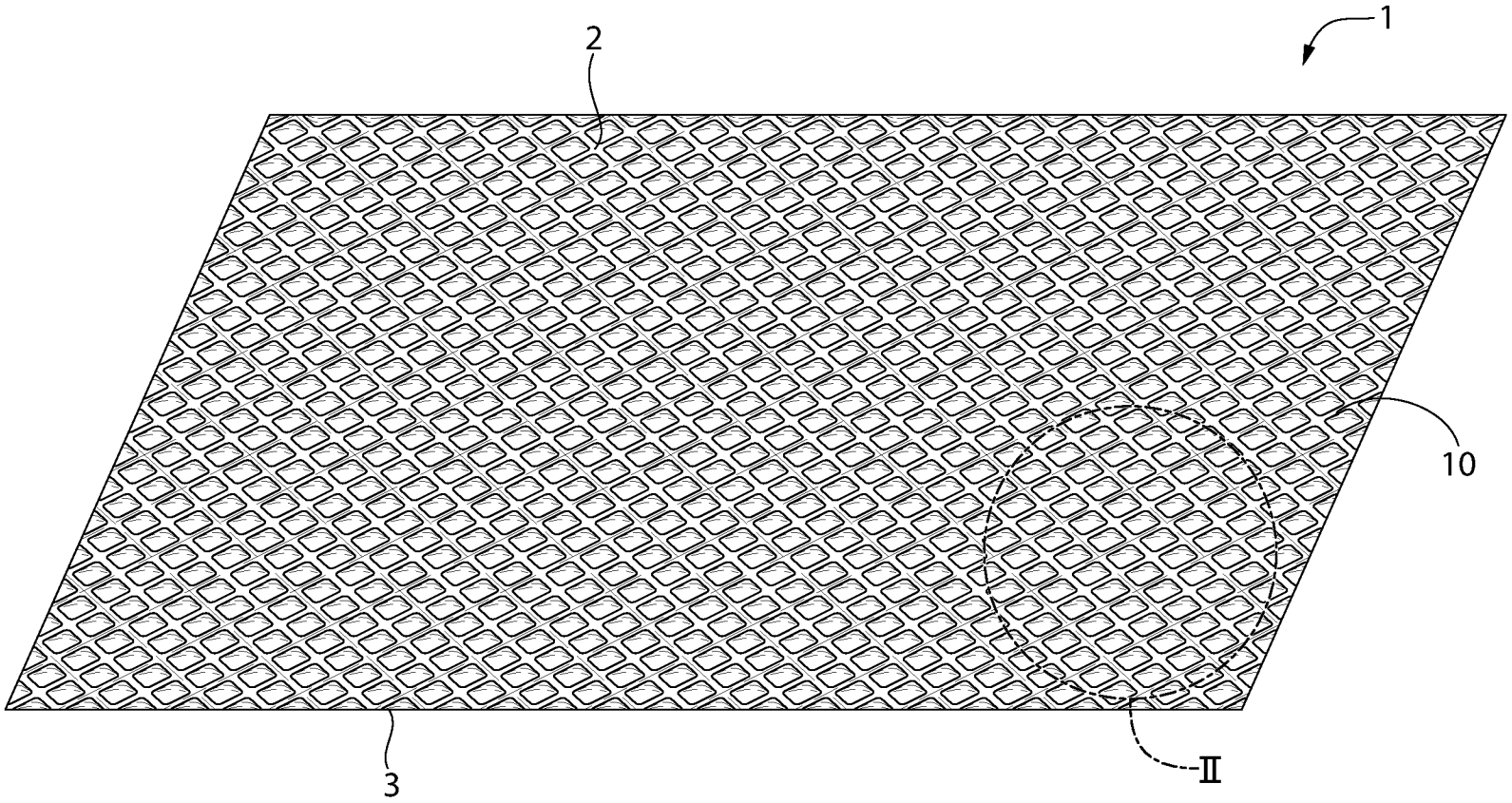
FIG. 1 is a perspective view of the fabric of the present invention.
Figure 2:
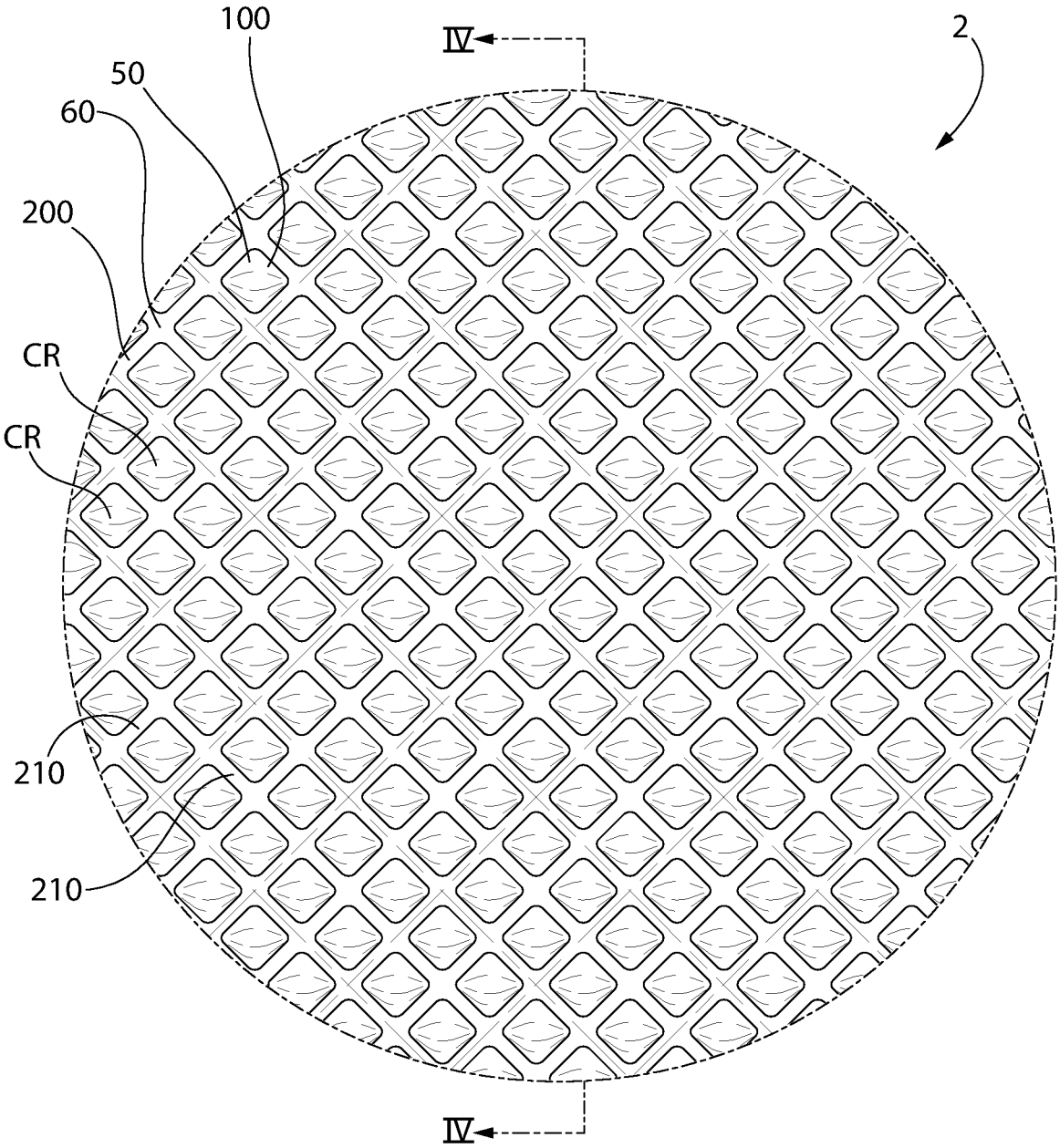
FIG. 2 is a close-up view of the first major surface of the fabric in region II shown in FIG. 1.
Figure 3:
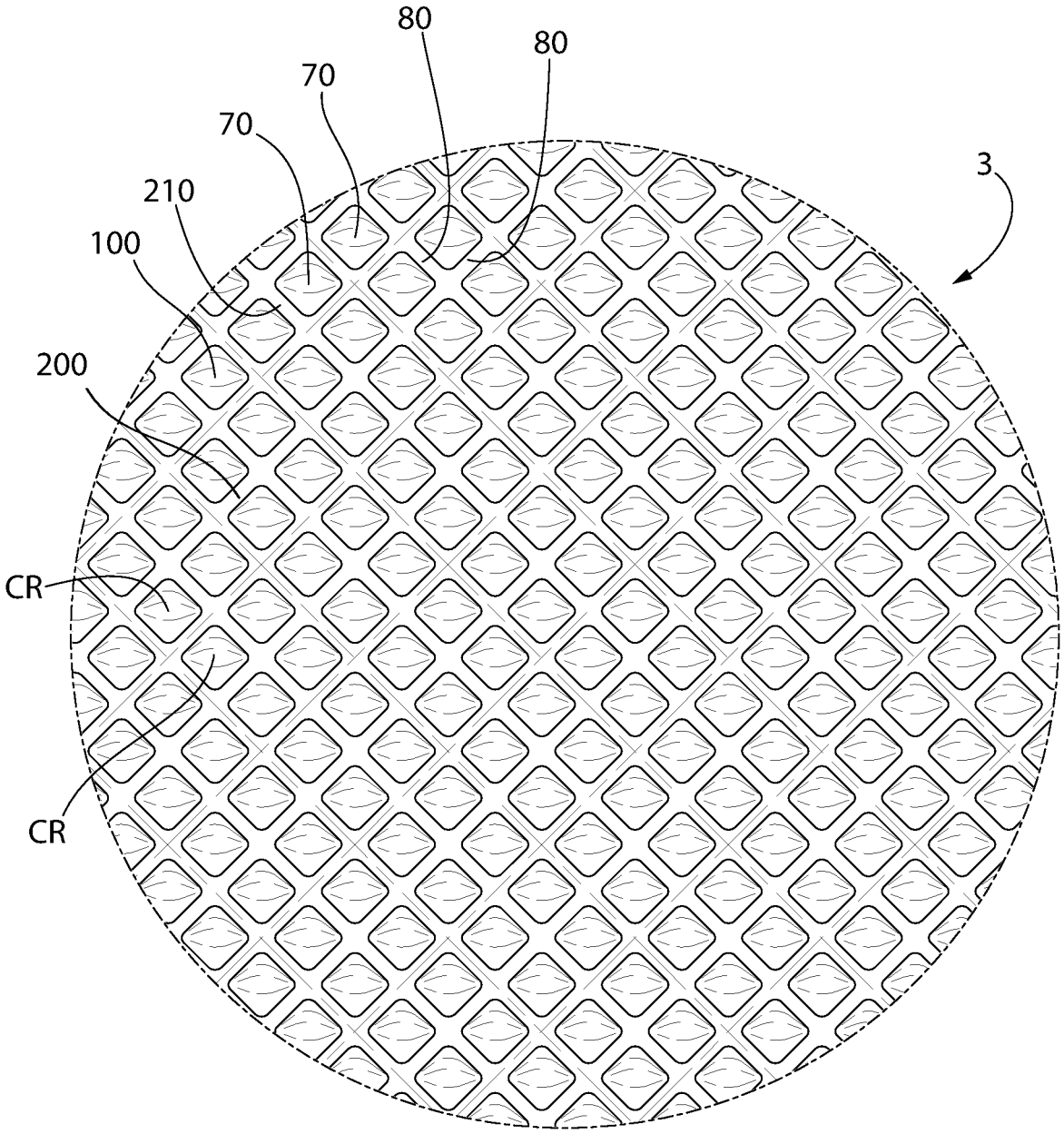
FIG. 3 is a close-up view of the second major surface of the fabric in region II shown in FIG. 1.
Figure 4:
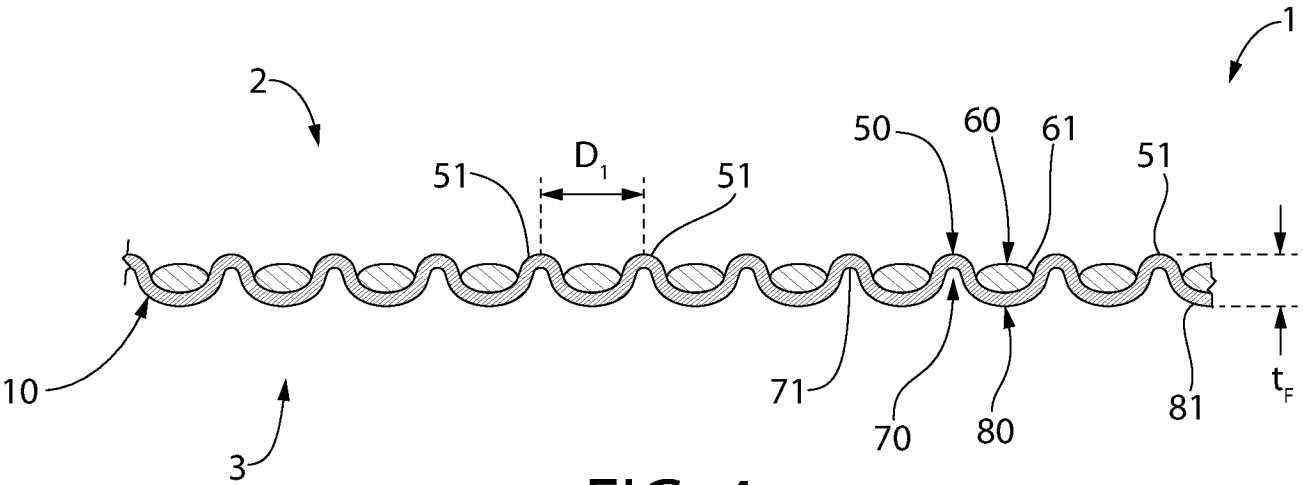
FIG. 4 is a cross-sectional view of the fabric along line V-V shown in FIG. 3.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means +/−5% of the reference value. According to the present application, the term "substantially free" less than about 0.1 wt. % based on the total of the referenced value.

FIGS. 1-4 shows a fabric 1 according to the present invention. The fabric 1 may be a warp knit fabric. The term 'warp knit fabric' refers to the fabric 1 having a warp knit construction 10. According to the present invention, the warp knit construction 10 refers to a knit that is different from a weft knit construction (such as flatbed knits and circular knits). The warp knit construction 10 of the present invention may be a raschel knit that is formed along a knit direction KD using a raschel knitting machine.

The fabric 1 may comprise a front major surface 2 (also referred to as the "technical back") opposite a rear major surface 3 (also referred to as the "technical face"). The front major surface 2 of the fabric 1 may comprise a plurality of protrusions 50 that are offset by a plurality of intersecting channels 60. Each of the protrusions 50 may extend outward from the plurality of intersecting channels 60 in a direction extending from the rear major surface 3 toward the front major surface 2 of the fabric 1. The protrusions 50 may terminate at an apex 51 that is vertically offset from a floor 61 of the intersecting channels 60 by a non-zero value. The protrusions 50 may terminate at an apex 51 that is vertically offset from a floor 61 of the intersecting channels 60 by a distance of at least 5 mils.

The front major surface 2 of the fabric 1 may comprise the apex 51 of the protrusion 50, the floor 61 of the intersecting channels 60, and the exposed surface extending there-between, thereby forming a first topography for the front major 2.

The rear major surface 3 of the fabric 1 may comprise a plurality of recesses 70 that are offset from each other by a plurality of intersecting walls 80. Each of the recesses 70 may extend inward from the plurality of intersecting walls 80 in a direction extending from the rear major surface 3 toward the front major surface 2 of the fabric 1. The recesses 70 may terminate at a recess floor 71 that is vertically offset from a top 81 of the intersecting walls 80 by a non-zero value. The recesses 70 may terminate at a recess floor 71 that is vertically offset from a top 81 of the intersecting walls 80 by a distance of at least 5 mils.

The rear major surface 3 of the fabric 1 may comprises the top 81 of the intersecting walls 80, the plurality of recess floors 71, and the exposed surface extending there-between, thereby forming a second topography for the rear major surface 3. The first topography and the second topography are different. The first topography and the second topography may be negatives of each other.

The fabric 1 may exhibit a fabric thickness $t_F$ as measured by the distance between the apex 51 of the protrusion 50 and the top 81 of the intersection walls 80. In a first state where no external stress is applied to the fabric 1, the fabric thickness $t_F$ may range from about 60 mils to about 120 mils—including all thicknesses and sub-ranges there-between. In a second state where external stress is applied in a direction that is substantially parallel to each of the front major surface 2 and the rear major surface 3—thereby stretching the fabric 1 along a plane substantially parallel to each of the front major surface 3 and the rear major surface 3—the fabric thickness $t_F$ may range from about 10 mils to about 30 mils—including all thicknesses and sub-ranges there-between.

In the first state, two adjacent apex 510 of two immediately adjacent protrusions 50 along first direction may be offset by a first distance $D_1$ that ranges from about 140 mils to about 250 mils—including all thicknesses and sub-ranges there-between. In the second state, the first distance $D_1$ may be a value of at least 300% the value of $D_1$ in the first state—including all thicknesses and sub-ranges there-between. The first direction may be parallel to a knit direction or may be substantial orthogonal to the knit direction (as discussed in greater detail herein).

Figure 5:
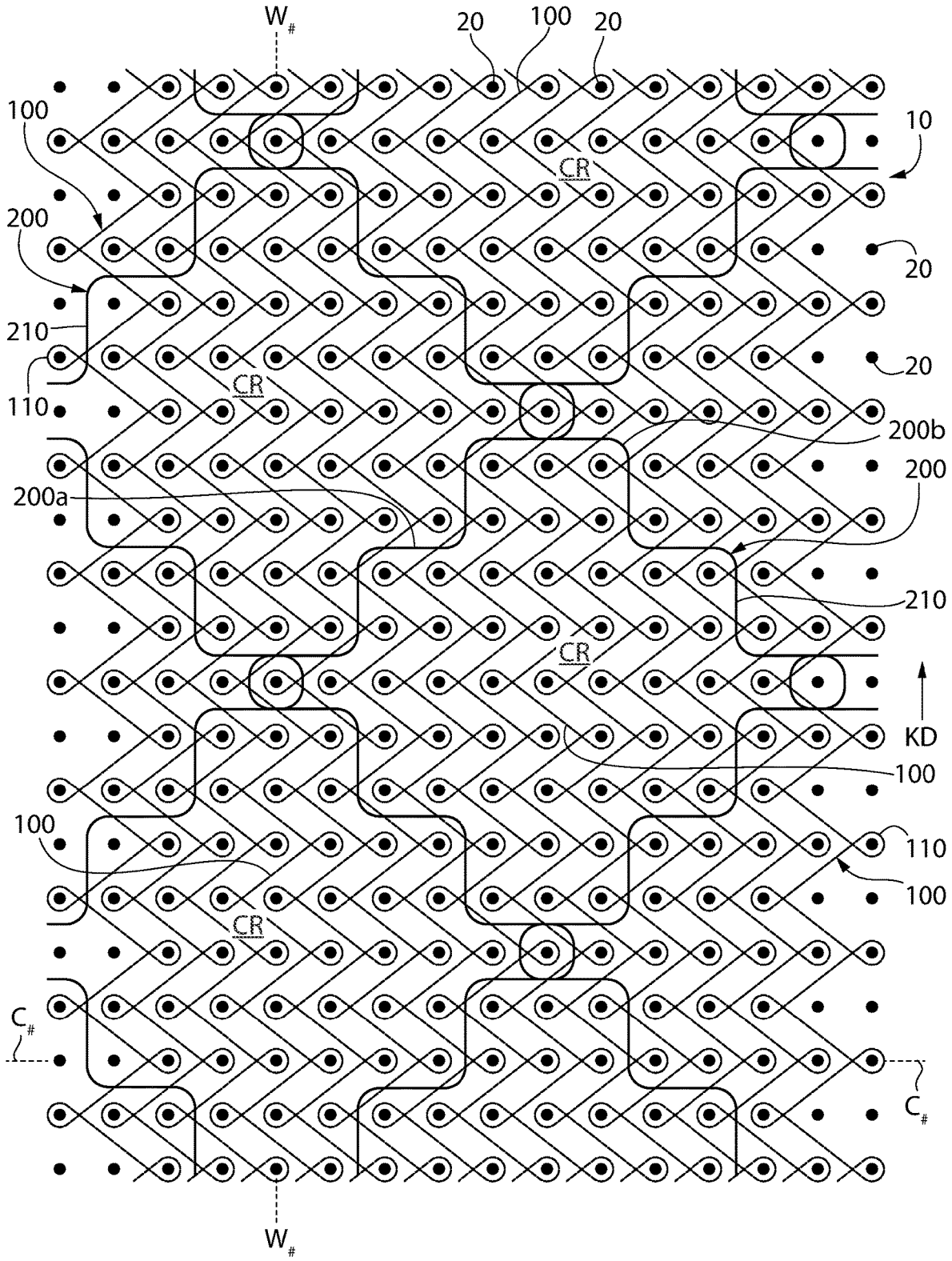
FIG. 5 is a stitch diagram of the knit pattern of the fabric of the present invention having a first yarn and a second yard.
Figure 6:
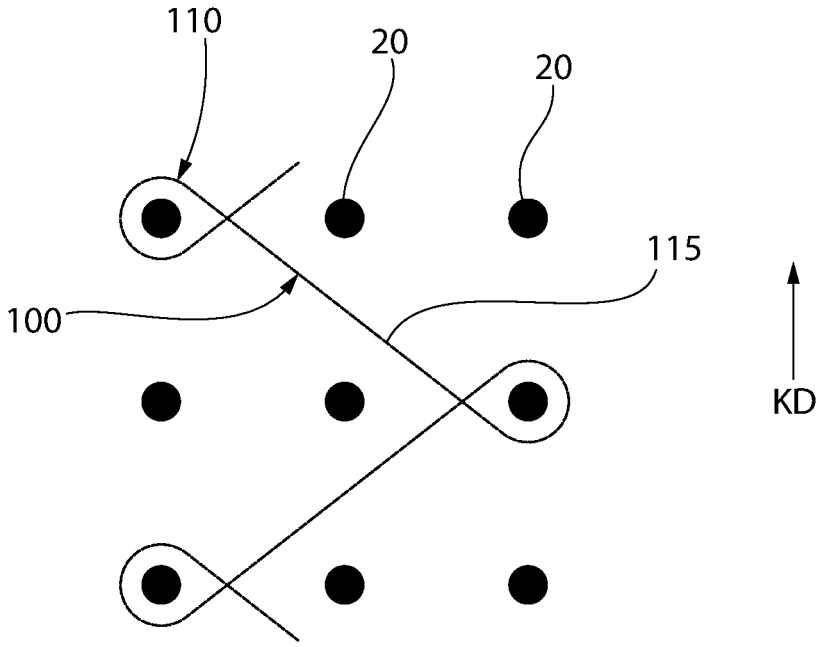
FIG. 6 is a stich diagram view of the first yarn shown in FIG. 5.
Figure 7:
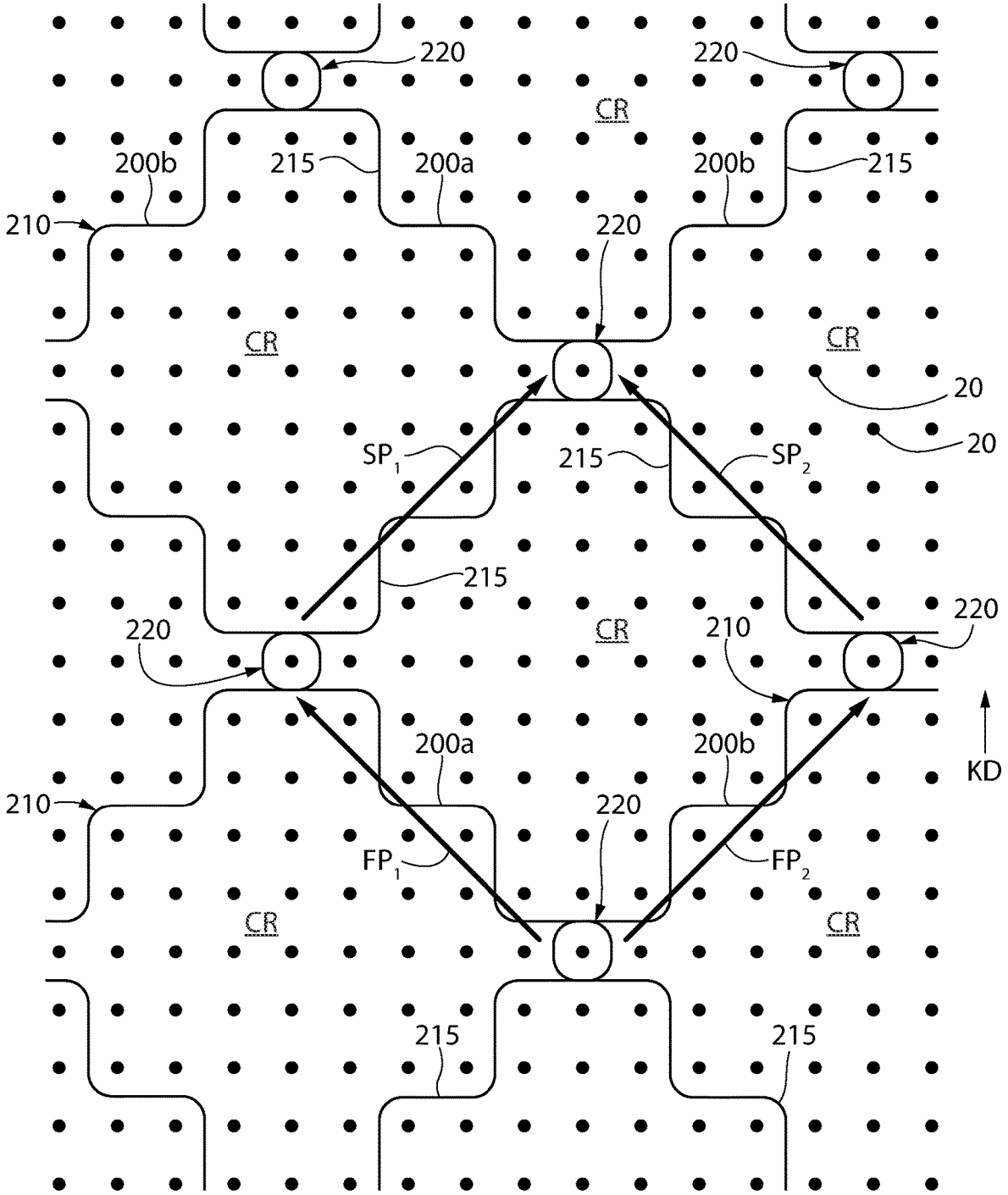
FIG. 7 is a view of the second yarn only, as shown in FIG. 5, for demonstrative purposes.

Referring now to FIGS. 5-7, a raschel knit may be formed in line with the movement of the needles along the knit direction KD. In a non-limiting example, the stitch diagram of FIGS. 5-7 may demonstrate how a warp knit construction 10 may be formed having two different yarns that are interconnected by cross stitches.

Referring to FIGS. 5-7, in particular, the warp knit construction 10 may be formed of a first yarn 100 (also referred to as a "first thread") and a second yarn 200 (also referred to as a "second thread"). The first yarn 100 may be different from the second yarn 200. In a preferred embodiment, the first yarn 100 is different from the second yarn 200.

As described in greater detail herein, the first yarn 100 may be a hard yarn (also referred to as an "inelastic yarn"), and the second yarn 200 may be an elastomeric yarn. The term "elastomeric yarn" refers to a yarn capable of deforming (e.g. elongating) from a first state to a second state under an applied stress and recovering to the first state from the second state once the applied stress is removed. The first state may be a first set of dimensions and the second state may be a second set of dimensions that are greater than the first set of dimensions in at least one direction (length, width, thickness). The term "hard yarn" refers to a yarn either not capable of deforming from the first state to the second state under an applied stress (i.e., the yarn either does not change dimensions or the yarn breaks under the applied stress) or refers to a yarn that transitions from the first state to the second state but does not exhibit recovery from the second state back to the first state once the applied stress is removed.

The warp knit construction 10 may comprise a plurality of stitches that are each formed by an interlocking knit loop 110 that is created by a needle 20 during knitting—whereby the travel along the needles 20 control the path of each of the first yarn 100 and the second yarn 200 within the warp knit construction 10. Each stitch may be represented by each knit loop 110 shown on the stitch diagram of FIGS. 5-6.

Referring to FIGS. 2-7, each protrusion 50 of the first major surface 2 may be formed by the first yarn 100. The apex 51 of each protrusion 50 may be formed from the first yarn 100. Each protrusion 50 of the first major surface 2 may be substantially free of the second yarn 200. The apex 51 of each protrusion 50 may be substantially free of the second yarn 200.

Each of the intersecting channels 60 of the first major surface 2 may comprise the second yarn 200. The floor 61 of each intersecting channel 60 may comprise the second yarn 200. Each of the intersecting channels 60 of the first major surface 2 may comprise the first yarn 100. The floor 61 of each intersecting channel 60 may comprise the first yarn 100.

Each recess 70 of the second major surface 3 may be formed by the first yarn 100. The floor 71 of each recess 70 may be formed from the first yarn 100. Each recess 70 of the second major surface 3 may be substantially free of the second yarn 200. The floor 71 of each recess 70 may be substantially free of the second yarn 200.

Each of the intersecting walls 80 of the second major surface 3 may comprise the second yarn 200. The top 81 of each intersecting wall 80 may comprise the second yarn 200. Each of the intersecting walls 80 of the second major surface 3 may comprise the first yarn 100. The top 81 of each intersecting wall 80 may comprise the first yarn 100.

The warp knit construction 10 may comprise a plurality of stitches, each stitch formed by the knit loop 110 of the first yarn 100, whereby a portion 115 of the first yarn 100 spans between the knit loops 110. The warp knit construction 10 may comprise a repeating array of cells 210 formed by the second yarn 200. Each cell 210 may be defined by a perimeter 215, whereby the perimeter 215 is formed by the second yarn 200. The perimeter 215 of each cell 210 may define a central region CR located entirely within the perimeter 215 of each cell 210. The perimeter 215 of each cell 210 may be a closed-perimeter. The plurality of cells 210 may define an array of central regions CR located inside of the plurality of cells 210.

Each cell 210 may be formed by the second yarn 200, whereby the second yarn 200 is an inlay yarn trapped within the warp knit construction 10 by the first yarn 100 that span across the entirety of the warp knit construction 10. The central region CR may be occupied the plurality of stitches. The central region CR may be occupied solely by the plurality of stitches. The central region CR may be occupied solely by the first yarn 100. The central region CR may be substantially free of the second yarn 200.

According to the present invention, a plurality of stitches of the first yarn 100 may be located within a single cell 210 of the second yarn 200. The number of stitches of the first yarn 100 located inside the perimeter 215 of a single cell 210 may range from about 20 to about 300—including all individual integers and sub-ranges there-between. In some embodiments, the number of stitches of the first yarn 100 located inside the perimeter 215 of a single cell 210 may range from about 40 to about 250—including all individual integers and sub-ranges there—between. In some embodiments, the number of stitches of the first yarn 100 located inside the perimeter 215 of a single cell 210 may range from about 45 to about 200—including all individual integers and sub-ranges there-between.

The perimeter of each cell 210 may be collectively formed by a combination of a first one 200*a* of the second yarn 200 and a second one 200*b* of the second yarn 200. Each of the first one 200*a* and the second one 200*b* of the second yarn 200 may be separate threads of the second yarn 200. Each of the first one 200*a* and the second one 200*b* of the second yarn 200 may be separate yarns. Independently, each of the first one 200*a* and the second one 200*b* may not be a bicomponent yarn.

Each one of the first one 200*a* and the second one 200*b* of the second yarn 200 may span along the knit direction KD in a repeating pattern across the courses $C_{\#}$-$C_{\#}$ and wales $W_{\#}$-$W_{\#}$ formed by the plurality of stitches of the first yarn 100. In a non-limiting embodiment, the first one 200*a* and the second one 200*b* of the second yarn 200 may overlap at a plurality of overlap points 220 to form the perimeter 215 of the cell 210. In a non-limiting embodiment, the first one 200*a* and the second one 200*b* of the second yarn 200 may overlap at a plurality of overlap points 220 to form the closed-perimeter 215 of the cell 210.

As demonstrated by FIGS. 5 and 7, the first one 200*a* of the second yarn 200 may be in-laid in a repeating pattern having a first repeating unit and the second one 200*b* of the second yarn 200 may be in-laid in a repeating pattern having a second repeating unit.

The first repeating unit of the first one 200*a* of the second yarn 200 may follow a first path $FP_1$ along the knit direction KD that spans a first plurality of wales and a first plurality of courses followed by a second path $SP_1$ that follows the knit direction KD and spans a second plurality of wales and a second plurality of courses.

The first plurality of wales and the first plurality of courses for the first path $FP_1$ of the first repeating unit may be equal. The first plurality of courses for the first path $FP_1$ of the first repeating unit and the second plurality of courses for the second path $SP_1$ of the first repeating unit may be equal. The first plurality of wales for the first path $FP_1$ of the first repeating unit and the second plurality of wales for the second path $SP_1$ of the first repeating unit may have opposite values, thereby causing the first one 200*a* of the second yarn 200 to return to the same wale from which the repeating unit started. For instance, the first plurality of wales of the first path $FP_1$ of the first repeating unit may be equal to six (6) and the second plurality of wales for the second path $SP_1$ of the first repeating may be equal to negative six (−6).

The first plurality of wales for the first path $FP_1$ of the first repeating unit may range from about 3 to about 30—including all integers and sub-ranges there-between. In some embodiments, the first plurality of wales for the first path $FP_1$ of the first repeating unit may range from about 5 to about 30—including all integers and sub-ranges there-between. In some embodiments, the first plurality of wales for the first path $FP_1$ of the first repeating unit may range from about 10 to about 30—including all integers and sub-ranges there-between.

The first plurality of courses for the first path $FP_1$ of the first repeating unit may range from about 3 to about 30—including all integers and sub-ranges there-between. In some embodiments, the first plurality of courses for the first path $FP_1$ of the first repeating unit may range from about 5 to about 30—including all integers and sub-ranges there-between. In some embodiments, the first plurality of courses for the first path $FP_1$ of the first repeating unit may range from about 10 to about 30—including all integers and sub-ranges there-between.

The second plurality of wales for the second path $SP_1$ of the first repeating unit may range from about 3 to about 30—including all integers and sub-ranges there-between. In some embodiments, the second plurality of wales for the second path $SP_1$ of the first repeating unit may range from about 5 to about 30—including all integers and sub-ranges there-between. In some embodiments, the second plurality of wales for the second path $SP_1$ of the first repeating unit may range from about 10 to about 30—including all integers and sub-ranges there-between.

The second plurality of courses for the second path $SP_1$ of the first repeating unit may range from about 3 to about 30—including all integers and sub-ranges there-between. In some embodiments, the second plurality of courses for the second path $SP_1$ of the first repeating unit may range from about 5 to about 30—including all integers and sub-ranges there-between. In some embodiments, the second plurality of courses for the second path $SP_1$ of the first repeating unit may range from about 10 to about 30—including all integers and sub-ranges there-between.

The second repeating unit of the second one 200*b* of the second yarn 200 may follow a first path $FP_2$ along the knit direction KD that spans a first plurality of wales and a first plurality of courses followed by a second path $SP_2$ that follows the knit direction KD and spans a second plurality of wales and a second plurality of courses.

The first plurality of wales and the first plurality of courses for the first path $FP_2$ of the second repeating unit may be equal. The first plurality of courses for the first path $FP_2$ of the second repeating unit and the second plurality of courses for the second path SP2 of the second repeating unit may be equal. The first plurality of wales for the first path $FP_2$ of the second repeating unit and the second plurality of wales for the second path $SP_2$ of the second repeating unit may have opposite values, thereby causing the second one 200*b* of the second yarn 200 to return to the same wale from which the repeating unit started. For instance, the first plurality of wales of the first path $FP_2$ of the second repeating unit may be equal to negative six (−6) and the second plurality of wales for the second path $SP_2$ of the second repeating may be equal to six (6).

The first plurality of wales for the first path $FP_2$ of the second repeating unit may range from about 3 to about 30—including all integers and sub-ranges there-between. The first plurality of wales for the first path $FP_2$ of the second repeating unit may range from about 5 to about 30—including all integers and sub-ranges there-between. The first plurality of wales for the first path $FP_2$ of the second repeating unit may range from about 10 to about 30—including all integers and sub-ranges there-between.

The first plurality of courses for the first path $FP_2$ of the second repeating unit may range from about 3 to about 30—including all integers and sub-ranges there-between. The first plurality of courses for the first path $FP_2$ of the second repeating unit may range from about 5 to about 30—including all integers and sub-ranges there-between. The first plurality of courses for the first path $FP_2$ of the second repeating unit may range from about 10 to about 30—including all integers and sub-ranges there-between.

The second plurality of wales for the second path $SP_2$ of the second repeating unit may range from about 3 to about 30—including all integers and sub-ranges there-between. In some embodiment, the second plurality of wales for the second path $SP_2$ of the second repeating unit may range from about 5 to about 30—including all integers and sub-ranges there-between. In some embodiments, the second plurality of wales for the second path $SP_2$ of the second repeating unit may range from about 10 to about 30—including all integers and sub-ranges there-between.

The second plurality of courses for the second path $SP_2$ of the second repeating unit may range from about 3 to about 30—including all integers and sub-ranges there-between. In some embodiments, the second plurality of courses for the second path $SP_2$ of the second repeating unit may range from about 5 to about 30—including all integers and sub-ranges there-between. In some embodiments, the second plurality of courses for the second path $SP_2$ of the second repeating unit may range from about 10 to about 30—including all integers and sub-ranges there-between.

The warp knit construction 10 may be formed by knitting the first yarn 100 on a first needle bar to form a plurality of knit loops 110 that span along a vertical direction between a first number of wales—whereby the first number of wales may range from about 2 to about 4, preferably from about 2 to about 3, including all integers and sub-ranges there-between—and in-laying the second yarn 200 with the first yarn 100 such that the second yarn 200 may extend along the vertical direction and has a repeating pattern that extends across at least 4 different wales for every 4 courses. In some embodiments, the second yarn 200 may extend along the vertical direction and have a repeating pattern that extends across at least 5 different wales for every 5 courses.

In a non-limiting example, the first one 200*a* of the second yarn 200 may have a first repeating unit such that the first one 200*a* of the second yarn 200 follows a first path $FP_1$ along the knit direction KD that spans from a sixth wale to a first wale (i.e., first plurality of wales of the first repeating unit) and spans from a first course to a sixth course (i.e., first plurality of courses of the first repeating unit) followed by a second path $SP_1$ that follows along the knit direction KD and spans from the first wale back to the sixth wale (i.e., second plurality of wales of the first repeating unit) and spans from the sixth course to an eleventh course (i.e., second plurality of courses of the first repeating unit). According to this non-limiting example, the second one 200*b* of the second yarn 200 may have a second repeating unit such that the second one 200*b* of the second yarn 200 follows a first path $FP_2$ along the knit direction KD that spans from the sixth wale to an eleventh wale (i.e., first plurality of wales of the second repeating unit) and spans from the first course to the sixth course (i.e., first plurality of courses of the second repeating unit) followed by a second path $SP_2$ that follows along the knit direction KD and spans from the eleventh wale back to the sixth wale (i.e., second plurality of wales of the second repeating unit) and spans from the sixth course to an eleventh course (i.e., second plurality of courses of the second repeating unit). The overlap between the first one 200*a* and the second one 200*b* at the first course and sixth wale as well as the overlap at the eleventh course and sixth wale forms the perimeter 215 of the cell 210.

The present invention is not limited to a value of six (6) for such first and second plurality of courses and wales. Thus, the previous example may further apply to first ones 200*a* and second ones 200*b* of the second yarn 200 when the first and second plurality of courses and wales span the aforementioned ranges.

Each individual cell 210 of the warp knit construction 10 may have a perimeter 215 that spans from about 5 to about 50 courses along the knit direction KD—including each integer value and sub-range there-between. Each individual cell 210 of the warp knit construction 10 may have a perimeter 215 that spans from about 5 to about 50 wales in a direction transverse to the knit direction KD—including each integer value and sub-range there-between.

The warp knit construction 10 of the fabric 1 may consist essentially of the first yarn 100 and the second yarn 200. The warp knit construction 10 of the fabric 1 may be substantially free of yarns other than the first yarn 100 and the second yarn 200.

The warp knit construction 10 may comprise the first yarn 100 in an amount ranging from about 85 wt. % to about 99 wt. %—including all amounts and sub-ranges there-between—based on the total weight of the warp knit construction 10. In some embodiments, the warp knit construction 10 may comprise the first yarn 100 in an amount ranging from about 90 wt. % to about 99 wt. %—including all amounts and sub-ranges there-between—based on the total weight of the warp knit construction 10. In some embodiments, the warp knit construction 10 may comprise the first yarn 100 in an amount ranging from about 91 wt. % to about 98 wt. %—including all amounts and sub-ranges there-between—based on the total weight of the warp knit construction 10. In some embodiments, the warp knit construction 10 may comprise the first yarn 100 in an amount ranging from about 92 wt. % to about 98 wt. %—including all amounts and sub-ranges there-between—based on the total weight of the warp knit construction 10. In some embodiments, the warp knit construction 10 may comprise the first yarn 100 in an amount ranging from about 93 wt. % to about 98 wt. %—including all amounts and sub-ranges there-between—based on the total weight of the warp knit construction 10. In some embodiments, the warp knit construction 10 may comprise the first yarn 100 in an amount ranging from about 94 wt. % to about 97 wt. %—including all amounts and sub-ranges there-between—based on the total weight of the warp knit construction 10. In some embodiments, the warp knit construction 10 may comprise the first yarn 100 in an amount ranging from about 95 wt. % to about 97 wt. %—including all amounts and sub-ranges there-between—based on the total weight of the warp knit construction 10.

In a non-limiting example, the first yarn 100 may be present in an amount of about 91 wt. % based on the total weight of the warp knit construction 10. In a non-limiting example, the first yarn 100 may be present in an amount of about 92 wt. % based on the total weight of the warp knit construction 10. In a non-limiting example, the first yarn 100 may be present in an amount of about 93 wt. % based on the total weight of the warp knit construction 10. In a non-limiting example, the first yarn 100 may be present in an amount of about 94 wt. % based on the total weight of the warp knit construction 10. In a non-limiting example, the first yarn 100 may be present in an amount of about 95 wt. % based on the total weight of the warp knit construction 10. In a non-limiting example, the first yarn 100 may be present in an amount of about 96 wt. % based on the total weight of the warp knit construction 10. In a non-limiting example, the first yarn 100 may be present in an amount of about 97 wt. % based on the total weight of the warp knit construction 10. In a non-limiting example, the first yarn 100 may be present in an amount of about 98 wt. % based on the total weight of the warp knit construction 10. In a non-limiting example, the first yarn 100 may be present in an amount of about 99 wt. % based on the total weight of the warp knit construction 10.

The fabric 1 may comprise the first yarn 100 in an amount ranging from about 85 wt. % to about 99 wt. %—including all amounts and sub-ranges there-between—based on the total weight of the fabric 1. In some embodiments, the fabric 1 may comprise the first yarn 100 in an amount ranging from about 90 wt. % to about 99 wt. %—including all amounts and sub-ranges there-between—based on the total weight of the fabric 1. In some embodiments, the fabric 1 may comprise the first yarn 100 in an amount ranging from about 91 wt. % to about 98 wt. % —including all amounts and sub-ranges there-between—based on the total weight of the fabric 1.

In some embodiments, the fabric 1 may comprise the first yarn 100 in an amount ranging from about 92 wt. % to about 98 wt. %—including all amounts and sub-ranges there-between—based on the total weight of the fabric 1. In some embodiments, the fabric 1 may comprise the first yarn 100 in an amount ranging from about 93 wt. % to about 98 wt. %—including all amounts and sub-ranges there-between—based on the total weight of the fabric 1. In some embodiments, the fabric 1 may comprise the first yarn 100 in an amount ranging from about 94 wt. % to about 97 wt. %—including all amounts and sub-ranges there-between—based on the total weight of the fabric 1. In some embodiments, the fabric 1 may comprise the first yarn 100 in an amount ranging from about 95 wt. % to about 97 wt. %—including all amounts and sub-ranges there-between—based on the total weight of the fabric 1.

In a non-limiting example, the first yarn 100 may be present in an amount of about 91 wt. % based on the total weight of the fabric 1. In a non-limiting example, the first yarn 100 may be present in an amount of about 92 wt. % based on the total weight of the fabric 1. In a non-limiting example, the first yarn 100 may be present in an amount of about 93 wt. % based on the total weight of the fabric 1. In a non-limiting example, the first yarn 100 may be present in an amount of about 94 wt. % based on the total weight of the fabric 1. In a non-limiting example, the first yarn 100 may be present in an amount of about 95 wt. % based on the total weight of the fabric 1. In a non-limiting example, the first yarn 100 may be present in an amount of about 96 wt. % based on the total weight of the fabric 1. In a non-limiting example, the first yarn 100 may be present in an amount of about 97 wt. % based on the total weight of the fabric 1. In a non-limiting example, the first yarn 100 may be present in an amount of about 98 wt. % based on the total weight of the fabric 1. In a non-limiting example, the first yarn 100 may be present in an amount of about 99 wt. % based on the total weight of the fabric 1.

The warp knit construction 10 may comprise the second yarn 200 in an amount ranging from about 1 wt. % to about 15 wt. %—including all amounts and sub-ranges there-between—based on the total weight of the warp knit construction 10. In some embodiments, the warp knit construction 10 may comprise the second yarn 200 in an amount ranging from about 1 wt. % to about 10 wt. %—including all amounts and sub-ranges there-between—based on the total weight of the warp knit construction 10. In some embodiments, the warp knit construction 10 may comprise the second yarn 200 in an amount ranging from about 2 wt. % to about 9 wt. % —including all amounts and sub-ranges there-between—based on the total weight of the warp knit construction 10. In some embodiments, the warp knit construction 10 may comprise the second yarn 200 in an amount ranging from about 2 wt. % to about 8 wt. %—including all amounts and sub-ranges there-between—based on the total weight of the warp knit construction 10. In some embodiments, the warp knit construction 10 may comprise the second yarn 200 in an amount ranging from about 2 wt. % to about 7 wt. %—including all amounts and sub-ranges there-between—based on the total weight of the warp knit construction 10. In some embodiments, the warp knit construction 10 may comprise the second yarn 200 in an amount ranging from about 3 wt. % to about 6 wt. %—including all amounts and sub-ranges there-between—based on the total weight of the warp knit construction 10. In some embodiments, the warp knit construction 10 may comprise the second yarn 200 in an amount ranging from about 3 wt. % to about 5 wt. % —including all amounts and sub-ranges there-between—based on the total weight of the warp knit construction 10.

In a non-limiting example, the second yarn 200 may be present in an amount of about 1 wt. % based on the total weight of the warp knit construction 10. In a non-limiting example, the second yarn 200 may be present in an amount of about 2 wt. % based on the total weight of the warp knit construction 10. In a non-limiting example, the second yarn 200 may be present in an amount of about 3 wt. % based on the total weight of the warp knit construction 10. In a non-limiting example, the second yarn 200 may be present in an amount of about 4 wt. % based on the total weight of the warp knit construction 10. In a non-limiting example, the second yarn 200 may be present in an amount of about 5 wt. % based on the total weight of the warp knit construction 10. In a non-limiting example, the second yarn 200 may be present in an amount of about 6 wt. % based on the total weight of the warp knit construction 10. In a non-limiting example, the second yarn 200 may be present in an amount of about 7 wt. % based on the total weight of the warp knit construction 10. In a non-limiting example, the second yarn 200 may be present in an amount of about 8 wt. % based on the total weight of the warp knit construction 10. In a non-limiting example, the second yarn 200 may be present in an amount of about 9 wt. % based on the total weight of the warp knit construction 10. In a non-limiting example, the second yarn 200 may be present in an amount of about 10 wt. % based on the total weight of the warp knit construction 10.

The fabric 1 may comprise the second yarn 200 in an amount ranging from about 1 wt. % to about 15 wt. %—including all amounts and sub-ranges there-between—based on the total weight of the fabric 1. In some embodiments, the fabric 1 may comprise the second yarn 200 in an amount ranging from about 1 wt. % to about 10 wt. %—including all amounts and sub-ranges there-between—based on the total weight of the fabric 1. In some embodiments, the fabric 1 may comprise the second yarn 200 in an amount ranging from about 2 wt. % to about 9 wt. %—including all amounts and sub-ranges there-between—based on the total weight of the fabric 1. In some embodiments, the fabric 1 may comprise the second yarn 200 in an amount ranging from about 2 wt. % to about 8 wt. %—including all amounts and sub-ranges there-between—based on the total weight of the fabric 1. In some embodiments, the fabric 1 may comprise the second yarn 200 in an amount ranging from about 2 wt. % to about 7 wt. %—including all amounts and sub-ranges there-between—based on the total weight of the fabric 1. In some embodiments, the fabric 1 may comprise the second yarn 200 in an amount ranging from about 3 wt. % to about 6 wt. %—including all amounts and sub-ranges there-between—based on the total weight of the fabric 1. In some embodiments, the fabric 1 may comprise the second yarn 200 in an amount ranging from about 3 wt. % to about 5 wt. %—including all amounts and sub-ranges there-between—based on the total weight of the fabric 1.

In a non-limiting example, the second yarn 200 may be present in an amount of about 1 wt. % based on the total weight of the fabric 1. In a non-limiting example, the second yarn 200 may be present in an amount of about 2 wt. % based on the total weight of the fabric 1. In a non-limiting example, the second yarn 200 may be present in an amount of about 3 wt. % based on the total weight of the fabric 1. In a non-limiting example, the second yarn 200 may be present in an amount of about 4 wt. % based on the total weight of the fabric 1. In a non-limiting example, the second yarn 200 may be present in an amount of about 5 wt. % based on the total weight of the fabric 1. In a non-limiting example, the second yarn 200 may be present in an amount of about 6 wt. % based on the total weight of the fabric 1. In a non-limiting example, the second yarn 200 may be present in an amount of about 7 wt. % based on the total weight of the fabric 1. In a non-limiting example, the second yarn 200 may be present in an amount of about 8 wt. % based on the total weight of the fabric 1. In a non-limiting example, the second yarn 200 may be present in an amount of about 9 wt. % based on the total weight of the fabric 1. In a non-limiting example, the second yarn 200 may be present in an amount of about 10 wt. % based on the total weight of the fabric 1.

The first yarn 100 may include natural yarn, synthetic yarn, and combinations thereof. Non-limiting examples of natural yarn include cotton, wool, rayon, and combinations thereof. Non-limiting examples of synthetic yarn include polyester, polyamide (i.e., nylon), polypropylene, viscose, acetate, and combinations thereof. Non-limiting examples of hard yarn include natural-synthetic blends, such as polyester-cotton blend. Non-limiting examples of elastic yarn include polyurethane, such as a thermoplastic polyurethane. Non-limiting examples of polyurethane may further include polyurethane-urea polymer, such as Spandex.

The first yarn 100 may not be a bicomponent yarn. The first yarn 100 may be substantially free of bicomponent yarns. The first yarn 100 may be substantially free of core-sheath yarn. The first yarn 100 may have a first denier. The first denier may range from about 20 to about 150—including all deniers and sub-ranges there-between. In some embodiments, the first denier may range from about 30 to about 120—including all deniers and sub-ranges there-between. In some embodiments, the first denier may range from about 40 to about 100—including all deniers and sub-ranges there-between. In a non-limiting embodiment, the first denier may be about 70.

In some embodiments, the first yarn 100 may comprise a plurality of first yarns that each have a different denier and formed of a variety of natural yarn, synthetic yarn, and combinations thereof—so long as the denier falls within the first denier range and the yarn type fall within the listed natural yarn, synthetic yarn, or combination yarn as described for the first yarn 100.

The second yarn 200 may not be a bicomponent yarn. The second yarn 200 may be substantially free of bicomponent yarn. The second yarn 200 may be substantially free of core-sheath yarn. The second yarn 200 may have a second denier. The second denier may range from about 205 to about 475—including all deniers and sub-ranges there-between. In some embodiments, the second denier may range from about 210 to about 460—including all deniers and sub-ranges there-between. In some embodiments, the second denier may range from about 210 to about 450—including all deniers and sub-ranges there-between. In some embodiments, the second denier may range from about 210 to about 440—including all deniers and sub-ranges there-between. In some embodiments, the second denier may range from about 210 to about 420—including all deniers and sub-ranges there-between.

In a non-limiting embodiment, the second denier may be about 210. In a non-limiting embodiment, the second denier may be about 240. In a non-limiting embodiment, the second denier may be about 280.

In some embodiments, the second denier may range from about 240 to about 475—including all deniers and sub-ranges there-between. In some embodiments, the second denier may range from about 240 to about 460—including all deniers and sub-ranges there-between. In some embodiments, the second denier may range from about 300 to about 440—including all deniers and sub-ranges there-between. In a non-limiting embodiment, the second denier may be about 420.

In some embodiments, the second yarn 200 may be formed of a single yarn having a single sized denier that falls within the second denier range and formed of a single type of elastomeric yarn. In other embodiments, the second yarn 200 may comprise a plurality of second yarns that each have a different denier—so long as the denier falls within the second denier range. In a non-limiting example, the second yarn may comprise two, three, four, five, six, seven, eight, nine, and ten different second yarns—each having a different denier that falls within the second denier range.

In a non-limiting example, the second yarn 200 may include a first portion and a second portion of the second yarn 200, whereby each thread of the first portion of the second yarn 200 has a denier falling within the second denier range and each thread of the second portion of the second yarn 200 has a denier falling within the second denier range, whereby the denier of the first portion of the second yarn 200 and the denier of the second portion of the second yarn 200 is different.

In a non-limiting example, the second yarn 200 may include a first portion, a second portion, and a third portion of the second yarn 200, whereby each thread of the first portion of the second yarn 200 has a denier falling within the second denier range, each thread of the second portion of the second yarn 200 has a denier falling within the second denier range, and each thread of the third portion of the second yarn 200 has a denier falling within the second denier range, and whereby the denier of the first portion of the second yarn 200, the denier of the second portion of the second yarn 200, and the denier of the third portion of the second yarn 200 is different.

In a non-limiting example, the second yarn 200 may include a first portion, a second portion, a third portion, and a fourth portion of the second yarn 200, whereby each thread of the first portion of the second yarn 200 has a denier falling within the second denier range, each thread of the second portion of the second yarn 200 has a denier falling within the second denier range, each thread of the third portion of the second yarn 200 has a denier falling within the second denier range, and each thread of the fourth portion of the second yarn 200 has a denier falling within the second denier range, and whereby the denier of the first portion of the second yarn 200, the denier of the second portion of the second yarn 200, the denier of the third portion of the second yarn 200, and the denier of the fourth portion of the second yarn 200 is different.

The warp knit construction 10 may be formed from the first yarn having the first denier and the second yarn having the second denier, whereby a ratio of the second denier to the first denier ranges from about 2:1 to about 16:1—including all ratios and sub-ranges there-between.

In some embodiments, the warp knit construction 10 may be formed from the first yarn having the first denier and the second yarn having the second denier, whereby a ratio of the second denier to the first denier ranges from about 2:1 to about 15:1—including all ratios and sub-ranges there-between. In some embodiments, the warp knit construction 10 may be formed from the first yarn having the first denier and the second yarn having the second denier, whereby a ratio of the second denier to the first denier ranges from about 6:1 to about 16:1—including all ratios and sub-ranges there-between. In some embodiments, the ratio of the second denier to the first denier ranges from about 5:1 to about 15:1—including all ratios and sub-ranges there-between. In some embodiments, the ratio of the second denier to the first denier ranges from about 7:1 to about 15:1—including all ratios and sub-ranges there-between. In some embodiments, the ratio of the second denier to the first denier ranges from about 8:1 to about 14:1—including all ratios and sub-ranges there-between. In some embodiments, the ratio of the second denier to the first denier ranges from about 9:1 to about 13:1—including all ratios and sub-ranges there-between. In some embodiments, the ratio of the second denier to the first denier ranges from about 10:1 to about 12:1—including all ratios and sub-ranges there-between. In some embodiments, the ratio of the second denier to the first denier ranges from about 10:1 to about 11:1—including all ratios and sub-ranges there-between. In a non-limiting example, the ratio of the second denier to the first denier is about 10.5:1.

It has been discovered that the knitted combination of the first yarn 100 at the first denier and the second yarn 200 at the second denier in the warp knit construction 10, whereby the first yarn 100 and the second yarn 200 are present in the aforementioned amounts and/or ratios results in a fabric 1 that exhibits a superior resistance to chemical degradation without sacrificing to the longevity of recovery performance necessary for a stretch fabrics.

It has been discovered that the knitted combination of the first yarn 100 forming a plurality of stitches and the second yarn 200 forming a repeating array of cells, whereby the number of stitches present in each cell ranges from 20 to 300 results in a fabric 1 that exhibits a superior resistance to chemical degradation without sacrificing to the longevity of recovery performance necessary for a stretch fabrics.

It has been discovered that the knitted combination of the first yarn 100 having a first denier ranging from about 20 to about 150 and a second yarn 200 in-laid through the first yarn 100, the second yarn having a second denier ranging from about 240 to about 450, whereby the first yarn 100 is present in an amount ranging from about 90 wt. % to about 99 wt. % and the second yarn is present in an amount ranging from about 1 wt. % to about 10 wt. % results in a fabric 1 that exhibits a superior resistance to chemical degradation without sacrificing to the longevity of recovery performance necessary for a stretch fabrics.

Stretch fabrics have many applications in active wear, which expose these materials to conditions that may not be suitable for prolonged deformation and recovery in such stretch fabrics—such as chlorinated pools. Therefore, a need exists for a new stretch fabric that is suitable for such active wear applications, and which can exhibit the necessary prolonged recovery characteristics that are needed for such applications.

Each of the first yarn 100 and the second yarn 200 of the present invention may be color-dyed.

The fabric 1 of the present invention may be used in the manufacture a textile article. The term 'textile article' includes, for example, a garment or article of clothing such as a shirt, pants, skirt, jacket, coat, work shirt, work pants, uniform, outerwear, sportswear, Swimsuit, bra, socks, and underwear, and also includes accessories Such as belts, gloves, mittens, hats, hosiery, or footwear. The term 'textile article' may also include such items as sheets, pillowcases, bedspreads, quilts, blankets, comforters, comforter covers, sleeping bags, shower curtains, curtains, drapes, tablecloths, napkins, wiping cloths, dish towels, and protective coverings for upholstery or furniture.

Examples

The following examples demonstrate the unexpected improvement in chemical degradation resistance for warp knit fabrics.

TABLE 1

| | Ex. 1 | Ex. 2 | Ex. 3 | Comp. Ex. 1 |
|---|---|---|---|---|
| Spandex Content | 4 wt. % | 8 wt. % | 6 wt. % | 54 wt. % |
| Spandex Denier | 420 | 280 | 210 | 140 |
| Nylon Content | 96 wt. % | 92 wt. % | 94 wt. % | 46 wt. % |
| Nylon Denier | 70 | 100 ± 30 | 100 ± 30 | 40 |
| Knit Type | Rachel | Rachel | Rachel | Tricot |
| Original Modulus | 0.38 | 0.74 | 1.05 | 3.37 |
| 3× Wet/Dry Modulus at 30% | 0.39 | 0.78 | 1.02 | 3.18 |
| 6× Wet/Dry Modulus at 30% | 0.3 | 0.70 | 1.06 | 3.12 |
| 9× Wet/Dry Modulus at 30% | 0.37 | 0.76 | 1.05 | 2.98 |
| 12× Wet/Dry Modulus at 30% | 0.38 | 0.63 | 1.13 | 3.03 |
| 15× Wet/Dry Modulus at 30% | 0.34 | 0.59 | 1.16 | 3.01 |
| 18× Wet/Dry Modulus at 30% | 0.38 | 0.66 | 1.10 | 2.88 |
| 21× Wet/Dry Modulus at 30% | 0.39 | 0.78 | 1.05 | 2.76 |
| % Modulus Change | 3% | 5% | 0% | −18% |

| | Comp. Ex. 2 | Comp. Ex. 3 | Comp. Ex. 4 | Comp. Ex. 5 |
|---|---|---|---|---|
| Spandex Content | 38 wt. % | 24 wt. % | 20 wt. % | 20 wt. % |
| Spandex Denier | 105 | 70 | 40 | 40 |
| Nylon Content | 62 wt. % | 76 wt. % | 80 wt. % | 80 wt. % |
| Nylon Denier | 40 | 45 | 70 | 70 |
| Knit Type | Tricot | Tricot | Tricot | Tricot |
| Original Modulus | 1.94 | 1.21 | 0.61 | 0.43 |
| 3× Wet/Dry Modulus at 30% | 1.66 | 1.07 | 0.4 | 0.31 |
| 6× Wet/Dry Modulus at 30% | 1.63 | 1.01 | 0.3 | 0.29 |
| 9× Wet/Dry Modulus at 30% | 1.57 | 0.95 | 0.17 | 0.2 |
| 12× Wet/Dry Modulus at 30% | 1.57 | 0.98 | 0.17 | 0.22 |
| 15× Wet/Dry Modulus at 30% | 1.54 | 0.96 | 0.12 | 0.18 |
| 18× Wet/Dry Modulus at 30% | 1.45 | 0.88 | 0.15 | 0.2 |
| 21× Wet/Dry Modulus at 30% | 1.41 | 0.84 | 0.11 | 0.16 |
| % Modulus Change | −27% | −31% | −82% | −63% |

| | Comp. Ex. 6 | Comp. Ex. 7 |
|---|---|---|
| Spandex Content | 20 wt. % | 19 wt. % |
| Spandex Denier | 40 | 40 |
| Nylon Content | 80 wt. % | 81 wt. % |
| Nylon Denier | 70 | 40 |
| Knit Type | Tricot | Tricot |
| Original Modulus | 1.73 | 0.72 |
| 3× Wet/Dry Modulus at 30% | 1.58 | 0.46 |
| 6× Wet/Dry Modulus at 30% | 1.54 | 0.45 |
| 9× Wet/Dry Modulus at 30% | 1.45 | 0.39 |
| 12× Wet/Dry Modulus at 30% | 1.5 | 0.43 |
| 15× Wet/Dry Modulus at 30% | 1.37 | 0.42 |
| 18× Wet/Dry Modulus at 30% | 1.39 | 0.30 |
| 21× Wet/Dry Modulus at 30% | 1.48 | 0.31 |
| % Modulus Change | −15% | 57% |

Each test sample fabric of Examples 1-3 and Comparative Examples 1-7 underwent a wet/dry modulus test, whereby each sample was exposed to a number of wet-cycles using chlorine containing water to simulate a swimming pool environment. The swimming pool environment included chlorine in an amount of 5 ppm and an alkalinity of 80 ppm at a pH of 7.5.

As demonstrated by Table 1, the combination of using a Rachel knit pattern with a hard yarn having a denier ranging from 70 to 130 and an elastomeric yarn having a denier ranging from 210 to 420 provided for a surprising improvement in the resistance to change in modulus after repeated wet-cycles as compared to fabrics with elastomeric yarn having a denier under 210. In particular, each of the inventive fabrics demonstrated a change in modulus that is 5% or less—whereas the comparative fabrics were at least 15% or more in the change in modulus.

Additionally, although not shown a fabric was not able to be formed using tricot pattern and with a hard yarn having a denier of 70 and an elastomeric yarn having a denier ranging from 210 to 420.

What is claimed is:

1. A fabric having a warp knit construction comprising:

a repeating array of cells, each cell defined by an inlay yarn;

a plurality of stiches formed inside of each cell, the plurality of stitches formed by a hard yarn having a denier ranging from about 20 to about 130 denier; and wherein the number of stitches per cell ranges from about 20 to about 300; and wherein the inlay yarn comprises an elastomeric yarn having a denier ranging from about 210 to about 420; and wherein the warp knit construction is a raschel knit; and wherein the inlay yarn is present in an amount ranging from about 1 wt. % to about 10 wt. % based on the total weight of the fabric, and wherein the hard yarn is present in an amount ranging from about 90 wt. % to about 99 wt. % based on the total weight of the fabric.

2. The fabric according to claim 1, wherein the elastomeric yarn selected from spandex yarn, rubber yarn, and thermoplastic polyurethane yarn.

3. The fabric according to claim 1, wherein the elastomeric yarn is not a bicomponent yarn, and wherein the hard yarn is not a bicomponent yarn.

4. The fabric according to claim 1, wherein the hard yarn is selected from the group consisting of polyester, polyamide, polypropylene, cotton, rayon, polyester-cotton blend.

5. The fabric according to claim 1, wherein each of the cells is defined by a closed perimeter that is formed by the inlay yarn.

6. The fabric according to claim 5, wherein the closed perimeter of each cell spans at least 5 wales in the warp knit construction, and wherein the closed perimeter of each cell spans at least 5 courses in the warp knit construction.

7. A fabric having a warp knit construction comprising:

a first yarn forming a plurality of stitches extending along in a knit direction, the first yarn comprising a hard yarn having a first denier ranging from about 20 to about 70;

a second yarn in-laid through the first yarn, the second yarn extending along the knit direction and having a repeating pattern that extends across at least 4 wales for every 4 courses, the second yarn having a second denier; and wherein a ratio of the second denier to the first denier ranges from about 2:1 to about 15:1.

8. The fabric according to claim 7, wherein the repeating pattern of the second yarn extends across at least 5 wales for every 5 courses.

9. The fabric according to claim 7, wherein the second denier ranges from about 210 to about 450.

10. The fabric according to claim 7, wherein the second yarn is selected from spandex yarn, rubber yarn, and thermoplastic polyurethane yarn.

11. The fabric according to claim 7, wherein the second yarn is present in an amount ranging from about 1 wt. % to about 10 wt. % based on the total weight of the fabric, and wherein the first yarn is present in an amount ranging from about 90 wt. % to about 99 wt. % based on the total weight of the fabric.

12. The fabric according to claim 7, wherein the warp knit construction is a raschel knit.

13. A fabric having a warp knit construction comprising:

a first yarn forming a plurality of stitches, the first yarn being a hard yarn and having a first denier ranging from about 20 to about 150;

a second yarn in-laid through the first yarn, the second yarn being an elastomeric yarn and having a second denier ranging from about 210 to about 450; and wherein the first yarn is present in an amount ranging from about 90 wt. % to about 99 wt. % based on the total weight of the fabric, and wherein the second yarn is present in an amount ranging from about 1 wt. % to about 10 wt. % based on the total weight of the fabric.

14. The fabric according to claim 13, wherein the first yarn is not a bicomponent yarn, and wherein the second yarn is not a bicomponent yarn.

15. The fabric according to claim 13, wherein the warp knit construction is a raschel knit.

16. The fabric according to claim 1, wherein the denier of the hard yarn ranges from about 20 to about 70.

17. The fabric according to claim 7, wherein the hard yarn comprises a first hard yarn and a second hard yarn, wherein the first denier of the first hard yarn is different from the first denier of the second hard yarn.

18. The fabric according to claim 13, wherein the hard yarn comprises a first hard yarn and a second hard yarn, wherein the first denier of the first hard yarn is different from the first denier of the second hard yarn.

19. The fabric according to claim 18, wherein the first denier of the first hard yarn is about 70 and the first denier of the second hard yarn is about 30.

20. The fabric according to claim 13, wherein the hard yarn comprises a first hard yarn and a second hard yarn, wherein the first hard yarn comprises nylon and the second hard yarn comprises one or more of polyester and nylon.

* * * * *